US008632442B2

(12) United States Patent
Lee

(10) Patent No.: US 8,632,442 B2
(45) Date of Patent: Jan. 21, 2014

(54) WEIGHT CONTROL APPARATUS FOR A WEIGHT TRAINING MACHINE

(76) Inventor: Byung Don Lee, Seoul (KR)

( * ) Notice: Subject to any disclaimer, the term of this patent is extended or adjusted under 35 U.S.C. 154(b) by 410 days.

(21) Appl. No.: 13/123,631

(22) PCT Filed: Oct. 23, 2009

(86) PCT No.: PCT/KR2009/006147

§ 371 (c)(1),
(2), (4) Date: Apr. 11, 2011

(87) PCT Pub. No.: WO2010/047554

PCT Pub. Date: Apr. 29, 2010

(65) Prior Publication Data

US 2011/0195823 A1 Aug. 11, 2011

(30) Foreign Application Priority Data

Oct. 23, 2008 (KR) ..... 10-2008-0104022

(51) Int. Cl.
*A63B 21/08* (2006.01)
*A63B 21/06* (2006.01)

(52) U.S. Cl.
USPC ..... 482/97; 482/94; 482/98

(58) Field of Classification Search
USPC ..... 482/93–103, 135–138, 107
See application file for complete search history.

(56) References Cited

U.S. PATENT DOCUMENTS 4,974,838 A * 12/1990 Sollenberger ..... 482/101
7,252,627 B2 * 8/2007 Carter ..... 482/98
7,473,211 B2 * 1/2009 Lee ..... 482/97
7,507,191 B2 * 3/2009 Zachary ..... 482/142
7,758,478 B2 * 7/2010 Golesh et al. ..... 482/98
7,766,800 B1 * 8/2010 Krull ..... 482/93
2002/0016238 A1 * 2/2002 Roy ..... 482/94
2006/0211549 A1 * 9/2006 Nohejl ..... 482/97
2011/0195823 A1 * 8/2011 Lee ..... 482/94

FOREIGN PATENT DOCUMENTS

KR 100425814 B1 4/2004
KR 1020040041847 A 5/2004
KR 100549407 B1 2/2006
KR 1020080056707 A 6/2008

OTHER PUBLICATIONS

International Search Report of International Application No. PCT/KR2009/006147, dated Jun. 17, 2010.

* cited by examiner

*Primary Examiner* — Stephen Crow
(74) *Attorney, Agent, or Firm* — Kile Park Reed & Houtteman PLLC

(57) ABSTRACT

Disclosed is a weight control apparatus for a weight training machine. The weight control apparatus includes a plurality of stacks which are fitted to a pair of guides standing upright between supports on a base such that the stacks slidably move up and down, and which have rectangular locking holes; a body arranged on a front surface of the base, in which the body has a plurality of insertion holes corresponding to the locking holes of the stacks and is provided at an upper portion thereof with a holder; and a cover arranged on the front surface of the body and having a plurality of locking pin members inserted into the insertion holes. Each locking pin member includes a rectangular stopper having a recess inwardly recessed, protrusions protruding from both sides of the recess, and locking protrusions protruding from both sides of the stopper; a shaft pin connected to a front end of the stopper; a button arranged on a front end of the shaft pin; and a conical coil spring arranged between the button and the shaft pin.

6 Claims, 13 Drawing Sheets

FIG. 1 [Prior Art]

FIG. 2 [Prior Art]

WEIGHT CONTROL APPARATUS FOR A WEIGHT TRAINING MACHINE

BACKGROUND

The present invention relates to a weight control apparatus for a weight training machine. More particularly, the present invention relates to a weight control apparatus for a weight training machine capable of allowing a user to conveniently adjust the weight of stacks of the weight training machine suitably for the user.

In general, a weight training machine includes a plurality of stacks which are selectively engaged with a wire assembly coupled with a handle in such a manner that a user can take exercise by properly setting the stacks suitably for the user.

As shown in FIGS. 1 and 2, a conventional weight training machine includes pulleys 12 installed at an upper portion of a support 10 having a base 11 and a wire 13 connected to a holder 14 such that the wire 13 can be wound around the pulleys 12. In addition, a fixing rod 15 having a plurality of holes extends downward from the holder 14.

A pair of guides 16 are standing upright at the center area of the support 10 such that the holder 14 can move up and down while being guided by the guides 16. In addition, a plurality of stacks 17 having insertion holes corresponding to the fixing rod 15 are fitted with the guides 16 such that the stacks 17 can move up and down. Further, a hole is formed at one side of each stack 17 corresponding to the holes of the fixing rod 15.

According to the conventional weight training machine having the above structure, the fixing rod 15 installed under the holder 14 is vertically inserted into the insertion holes formed at the center of the stacks 17 and a user sets the weight of the stacks 19 by coupling one of the stacks 17 with the fixing rod 15.

Applicant of the present invention has filed Korean Patent Registration No. 10-0425814 entitled "weight control apparatus for a weight training machine".

FIG. 3 shows the weight control apparatus of the weight training machine. As shown in FIG. 3, a pair of guides 420 are mounted on the upper part of a base 410 to which a support (not shown) is mounted and a plate 210 is mounted to the guides 420 such that the plate 210 can slidably move up and down. In addition, a fixing device 100 having a plurality of fixing pins 130 is mounted in the downward direction at one end of the plate 210.

A plurality of stacks 310 are mounted to the guides 420 installed on the base 410. Each of the stacks 310 is formed in the shape of a brick with a depressed side. Each of the stacks 310 is provided at either end thereof with a bearing (not shown). At the side of the depressed part of the stack 310, an insertion hole 311 is formed and the fixing pin 130 of the fixing device 100 is inserted into the insertion hole 311, which will be described below.

The fixing device 100 mounted to the one end of the plate 210 is placed at the depressed part of the stack 310.

The fixing device 100 includes a body 110 having a hollow rectangular shape. A locking member 120 provided lengthwise thereof with a plurality of hooks 121 is installed in the body 110. The locking member 120 is provided at the upper portion or the lower portion thereof with a spring 122 so that the locking member 120 is moved up and down due to elasticity of the spring 122 and engaged with the fixing pin 130, which will be described below.

In addition, a plurality of fixing pins 130 are inserted into the body 110 of the fixing device 100 from the front portion to the rear portion of the body 110 of the fixing device 100. A push button 140 is provided at one end of the fixing pin 140 and a spring 150 is installed between the push button 140 and an outer surface of the body 110 of the fixing device 100 to support the fixing pin 130. Guide protrusions are provided lengthwise along the fixing pin 130 and a locking protrusion 131 is provided in the fixing pin 130 to allow the fixing pin 130 to engage with the hook 121 of the locking member 120.

Further, a stopper is provided at the end of the guide protrusion. Thus, when the fixing pin 130 is inserted into the body 110 of the fixing device 100, the fixing pin 130 is supported by elasticity of the spring 150 installed between the body 110 of the fixing device 100 and the push button 140, so that the fixing pine 130 is prevented from being separated from the body 110 of the fixing device.

However, several problems have been found in the above patent.

First, the fixing pin having the cylindrical structure is inserted into the circular hole of the stack, so that the stack is shaken to the left or right when the stack is moved up and down.

Second, when the locking protrusion of the fixing pin is locked with the hook of the locking member, if the user pushes the fixing pin, the locking protrusion pushes the hook. Thus, even if the locking member is moved back, the locking protrusion of the fixing pin may not be completely separated from the hook of the locking member, so that two fixing pins are locked with the hook of the locking member.

Third, since there is no means for reducing the frictional coefficient or lubricating between the locking member and a bottom of the body, the user must push the button with strong force. For this reason, the user may feel inconvenience. Further, since the user pushes the button with strong force, an excessive load is applied to an inclined surface of the locking member so that the inclined surface may be worn or deformed, causing the malfunction.

Fourth, if the user pushes another button while the user is taking exercise by setting the weight using one button, another button is also operated so that the unintentional problem may occur.

Fifth, the thickness of the body of the fixing device is too thick, so the body may protrude in the front direction beyond the stack. Thus, the volume of the apparatus may be increased, the external appearance of the apparatus may be deteriorated, and the manufacturing cost may be increased.

SUMMARY

The present invention is the improvement of the Korean Patent Registration No. 10-0425814 and an object of the present invention is to provide a weight control apparatus of a weight training machine, in which a fixing pin inserted into the stack has a plate shape so that the stacks are not shaken to the left or right, a locking member is improved to precisely perform the locking and release operation between a locking protrusion of the fixing pin and the locking member, the locking member is prevented from being deformed or subject to friction to improve the convenience and durability, another button is not operated when one button has been operated to ensure the safety, and the volume of the apparatus is reduced so that the apparatus has the compact structure.

In order to accomplish the above object, there is provided a weight control apparatus of a weight training machine. The weight control apparatus includes a plurality of stacks which are fitted to a pair of guides standing upright between supports on a base such that the stacks slidably move up and down, and which have rectangular locking holes; a body arranged on a front surface of the base, in which the body has a plurality of insertion holes corresponding to the locking holes of the stacks and is provided at an upper portion thereof with a holder; and a cover arranged on the front surface of the body and having a plurality of locking pin members inserted into the insertion holes. Each locking pin member includes a rectangular stopper having a recess inwardly recessed, protrusions protruding from both sides of the recess, and locking protrusions protruding from both sides of the stopper; a shaft pin connected to a front end of the stopper; a button arranged on a front end of the shaft pin; and a conical coil spring arranged between the button and the shaft pin.

As described above, according to the present invention, the stack is not shaken to the left or right when the stack is moved up and down so the user can take exercise smoothly. In addition, the locking and releasing operation of the stopper can be precisely performed. Further, the user can smoothly push the button and abrasion of the locking member can be minimized. In addition, the volume of the apparatus can be reduced, the aesthetic appearance of the apparatus can be improved and the manufacturing cost of the apparatus can be reduced.

DETAILED DESCRIPTION OF THE EMBODIMENTS

Figure 1:
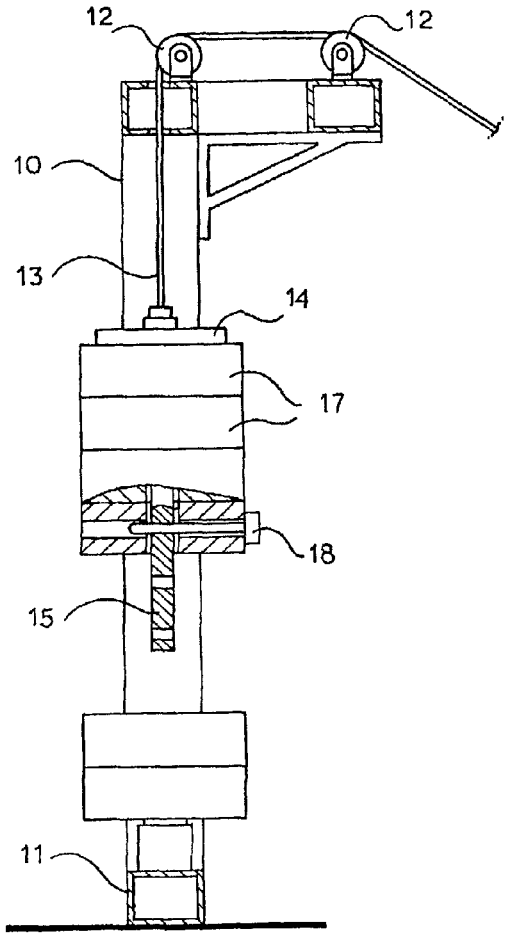
FIGS. 1 and 2 are views showing a weight training machine according to the related art.

Hereinafter, exemplary embodiments of the present invention will be described with reference to accompanying drawings.

In the following description, the same reference numerals will be assigned to elements and structures identical to those of the related art and detailed description thereof will be omitted in order to avoid redundancy.

Figure 4:
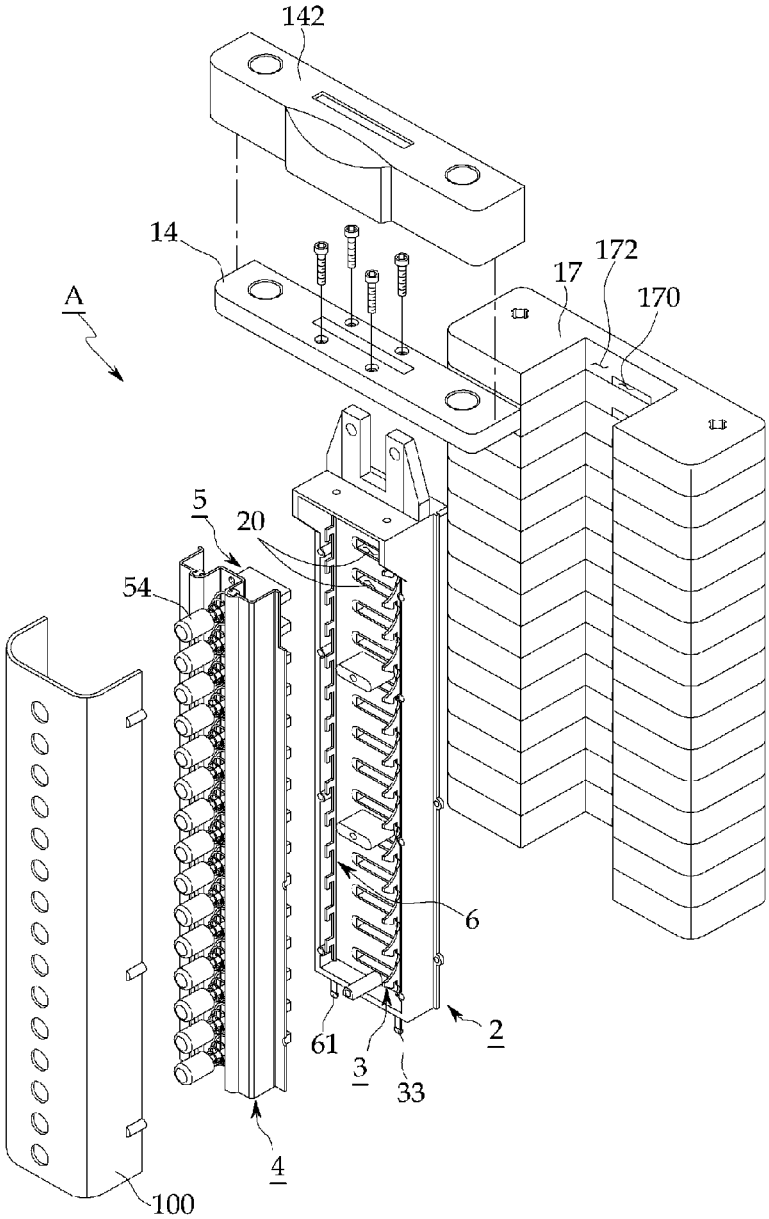
FIG. 4 is an exploded perspective view showing a weight control apparatus of a weight training machine according to the present invention.

FIG. 4 is an exploded perspective view showing a weight control apparatus of a weight training machine according to the present invention.

Figure 2:
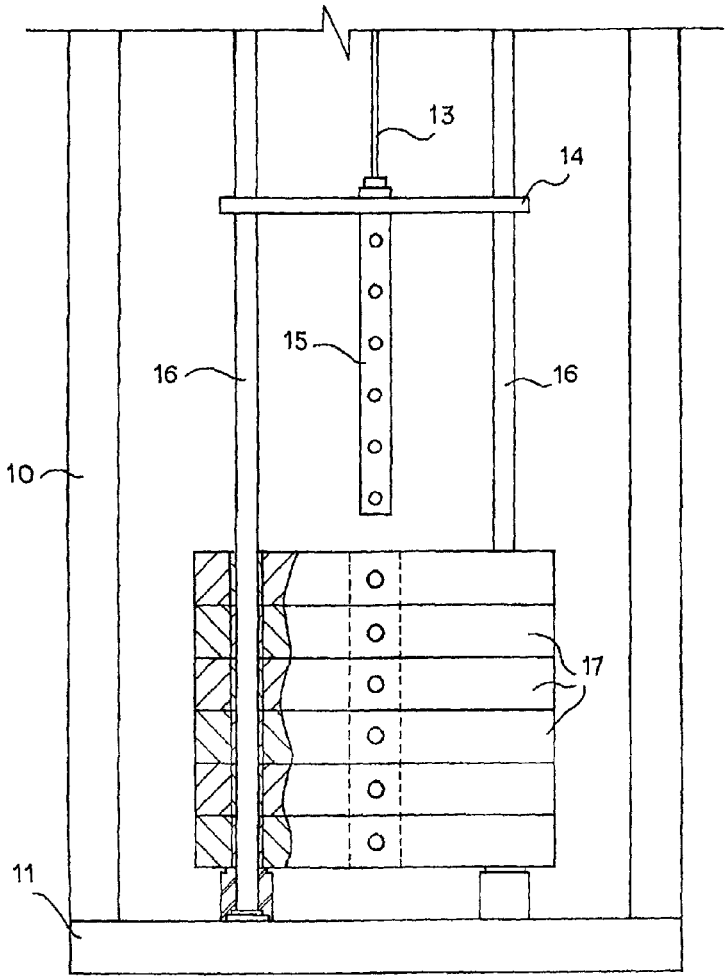
Figure 3:
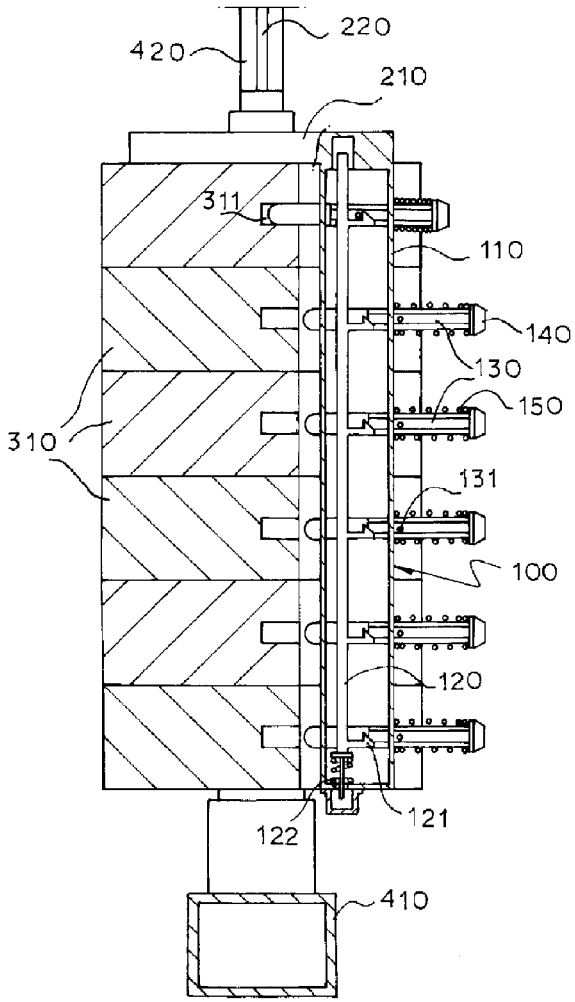
FIG. 3 is a view showing a weight control apparatus of a weight training machine which has been filed by applicant of the present invention.

Referring to FIGS. 1, 2 and 4, the weight control apparatus A of the weight training machine according to the present invention includes a base 11, supports 10 installed on the base 11, a pair of guides 16 vertically disposed between the supports 10, a plurality of stacks having rectangular fixing holes 170 and installed to the guides 16 to slidably move up and down, a body 2 installed at a front surface of the base, formed with a plurality of insertion holes 20 corresponding to the fixing holes 170 of the stacks 17 and provided at an upper portion thereof with a holder 14, and a cover 4 installed at a front surface of the body 2 and provided with a plurality of fixing pin members 5 inserted into the insertion holes 20.

The stacks 17 are weights having the rectangular brick shape and a recess 172 is formed at the center of each stack 17. The fixing hole 170 is formed in the recess 172. The fixing hole 170 has a rectangular shape identical to the shape of the fixing fin member 5.

The holder 14 is provided at the upper portion of the body 2 and a holder case 142 is provided at an outer portion of the holder 14. The body 2 is installed in the recess 172 of the stacks 17 and moves up and down together with the stacks 17 when a user pushes a button 54.

The insertion holes 20 are provided lengthwise along the body 2 in correspondence with the fixing holes 170 of the stacks 17. The insertion holes 20 have the rectangular shape identical to the shape of the fixing holes 170.

A plurality of rolling grooves 23 (see, FIGS. 6 and 7) are formed at both sides of the insertion holes 20 of the body 2. Rolling units 36 are installed in the rolling grooves 23 in such a manner that the rolling units 36 can make contact with a plate member 32 of the locking member 3 and a plate member 60 of the safety guide 6.

Figure 5:
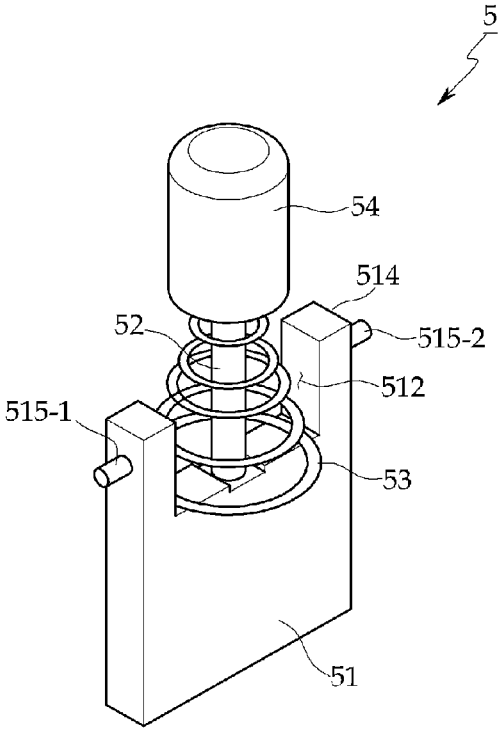
FIG. 5 is a perspective view showing a fixing pin member of FIG. 4.

FIG. 5 is a perspective view showing the fixing pin member of FIG. 4.

As shown in FIG. 5, the fixing pin member 5 includes a rectangular stopper 51 provided at both upper side ends thereof with locking protrusions 515-1 and 515-2 opposite to each other, a shaft pin 52 connected to the upper end of the stopper 51, a button 54 installed at an upper end of the shaft pin 52, and a conical coil spring 53 installed between the button 54 and the shaft pin 52.

The stopper 51 is made from a metal and inserted into the insertion hole 20 of the body 2 and the fixing hole 170 of the stack 17 to allow the user to set the weight of the stacks 17. A recess 512 is formed at the upper end of the stopper 51, so that protrusions 514 are formed at both upper side ends of the stopper 51. One end of the shaft pin 52 is screw-coupled into the bottom of the recess 512 and the locking protrusions 515-1 and 515-2 are provided at both upper side ends of the stopper 51.

As shown in the drawings, the conical coil spring 53 has a diameter which is gradually reduced from a bottom to a top thereof. Thus, when the conical coil spring 53 is compressed, the conical coil spring 53 is flattened in a spiral shape, so that the volume of the conical coil spring 53 can be minimized.

Since the recess 512 is formed in the stopper 51 and the conical coil spring 53 is provided in the stopper 51, the length of the shaft pin 52 can be shortened, so that the volume of the weight control apparatus according to the present invention can be reduced.

Figure 6:
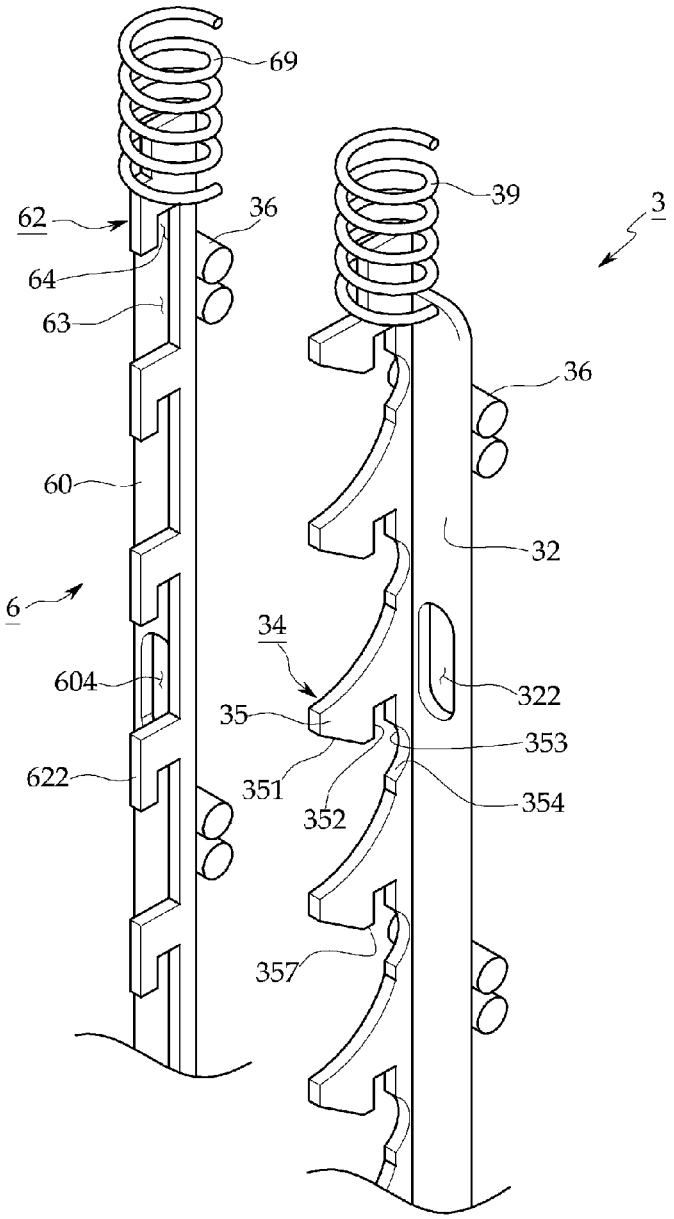
FIG. 6 is a perspective view showing a locking member and a safety guide of FIG. 4.

FIG. 6 is a perspective view showing the locking member and the safety guide of FIG. 4.

Referring to FIG. 6, the locking member 3 and the safety guide 6 are installed in the body 2 such that the locking protrusions 515-1 and 515-2 of the fixing pin member 5 can be coupled with or decoupled from the locking member 3 and the safety guide 6.

The locking member 3 includes the plate member 32 having a predetermined length and provided at an upper portion thereof with a spring 39 and a locking protrusion 34 having a saw-tooth shape and provided at one side of the plate member 32.

The plate member 32 is a metal plate vertically installed corresponding to the rolling groove 23 formed at one side of the insertion holes 20 of the body 2. The spring 39 is fitted with the upper end portion of the plate member 32 so that the plate member 32 can be elastically coupled with the upper surface of the body 2 and a plurality of elongated holes 322 are formed at the middle part of the plate member 32. A lower end of the plate member 32 protrudes to the outside through a perforation hole (not shown) formed at the lower end of the body 2 and is attached to a reset button 33 (see, FIGS. 4, 6, and 7).

The locking protrusion 34 includes a protrusion 35 formed at a front lower end thereof with a first inclined surface 351, a recess 352 adjacent to a lower portion of the first inclined surface 351 of the protrusion 35, and an arc-shape groove 354 formed at a lower portion of the recess 352.

When viewed in a side view, the protrusion 35 has a trapezoidal shape and the first inclined surface 351 is inclined downward. In particular, a region between the first inclined surface 351 and the recess 352 is horizontally incised, so that an incised surface 357 is formed.

The recess 352 is recessed at the end of the incised surface 357 and the locking protrusion 515-1 of the stopper 51 is inserted into the recess 352.

The arc-shape groove 354 is formed next to the recess 352 at the lower portion of the recess 352. Preferably, a start point of the arc-shape groove 354 is in line with the incised surface 357.

The safety guide 6 will be further described later in detail.

Figure 7:
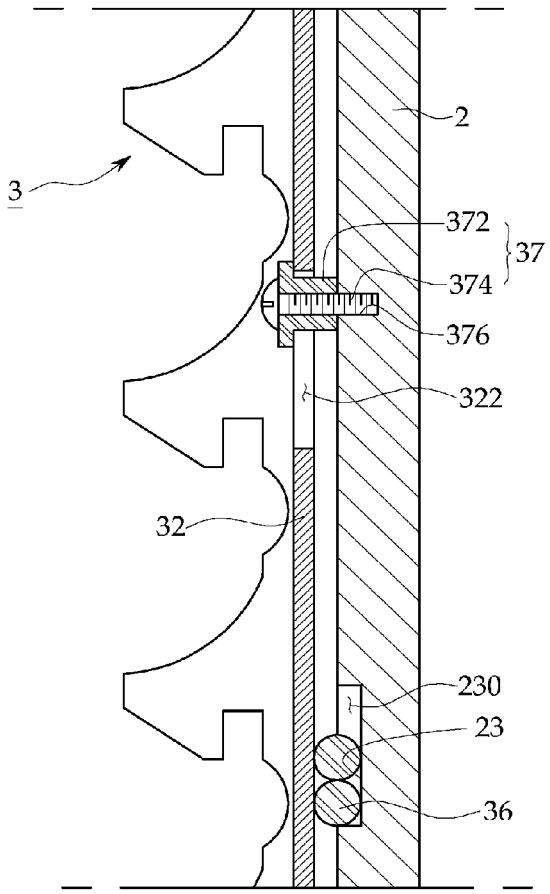
FIG. 7 is a longitudinal sectional view showing a coupling state between a fixing plate member and a body.

FIG. 7 is a longitudinal sectional view showing a coupling state between the fixing plate member and the body.

Referring to FIG. 7, a shaft pin member 37 is inserted into the elongated hole 322 formed in the plate member 32 so that the plate member 32 can move up and down.

The shaft pin member 37 includes a bushing 372 inserted into the elongated hole 322 and a bolt 374 screw-coupled into a screw hole 376 of the body 2 by passing through the bushing 372.

As shown in FIG. 7, the rolling unit 36 is installed between the plate member 32 of the locking member 3 and the inner surface of the body 2. Preferably, the rolling unit 36 includes a cylindrical roller, such as a needle bearing.

In addition, the rolling unit 36 is inserted into the rolling groove 23 formed in the body 23 to facilitate the movement of the plate member 32.

Thus, when the plate member 32 moves up and down, the friction between the plate member 32 and the inner surface of the body 2 is attenuated by the rolling unit 36, so that the user can smoothly operate the button 54 with little force, thereby preventing the first inclined surface 351 of the locking member 3 from being worn.

The rolling groove 23 has a width sufficient to receive two rolling units 36 therein. Preferably, a margin space 230 is formed in the rolling groove 23 when the two rolling units 36 are accommodated in the rolling groove 23. Thus, when the plate member 32 moves up and down, the rolling units 36 may roll in the rolling groove 23 due to the margin space 230 so that the plate member 32 can smoothly move up and down.

Referring again to FIG. 4, the reset button 33 is attached to the lower end of the locking member 3, which protrudes out of the body 2.

Upon emergency or A/S, the reset button 33 resets the weight control apparatus by releasing the locking state of the fixing pin member 5. If the user pushes up the reset button 33 by using a finger, the locking member 3 is pushed upward, so that all stoppers 51 are released, thereby initializing the weight control apparatus.

Figure 10:
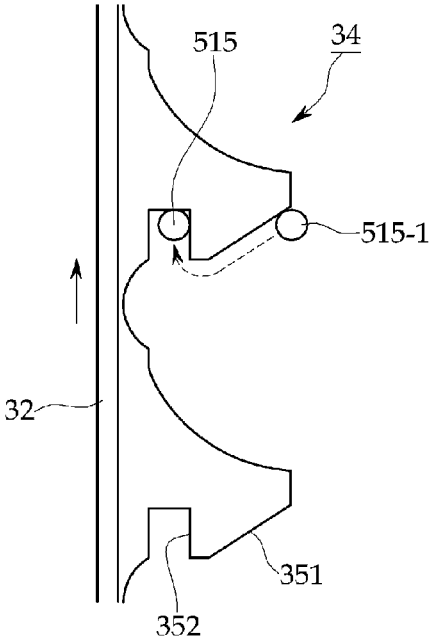
FIG. 10 is a view showing an operational state of a fixing pin member in a weight control apparatus of a weight training machine according to the present invention.

Referring to FIG. 10, when the reset button 33 is pushed up, the locking member 3 is moved upward, so that the spring 39 is compressed. Thus, the locking protrusion 515-1 of the stopper 51 is separated from the recess 352.

That is, the locking protrusion 515-1 of the stopper 51 is separated from the recess 352 due to the elasticity of the conical coil spring 53 and the stopper 51 is released from the fixing hole 170 of the stack 17 so that the button 54 returns to its initial position.

Meanwhile, the safety guide 6 is installed in the body 2 in opposition to the locking member 3.

Referring to FIG. 6, the safety guide 6 includes a plate member 60 having a predetermined length and provided at an upper end thereof with a safety spring 69, a plurality of locking protrusions 62 and a plurality of recesses 63. The locking protrusions 62 and the recesses 63 are alternately formed with the regular interval at one side of the plate member 60.

The locking protrusions 62 have vertical surfaces 622 and the recesses 63 are formed below the vertical surfaces 622. The locking protrusions 62 have substantially reverse-L shapes.

The plate member 60 is a metal plate vertically installed corresponding to the rolling groove 23 formed at one side of the insertion holes 20 of the body 2. The safety spring 69 is fitted with the upper end of the plate member 60 to allow the plate member 60 to be elastically coupled with the upper surface of the body and a plurality of elongated holes 604 having a predetermined length are formed at the middle of the plate member 60. In addition, the lower end of the plate member 60 protrudes to the outside through a perforation hole (not shown) formed at the lower end of the body 2 and a locking button 61 (see, FIG. 4) is attached to the lower end of the plate member 60.

The shaft pin member 37 is inserted into the elongated hole 604 of the safety guide 6 to guide the up-down movement of the plate member 60.

Figure 8:
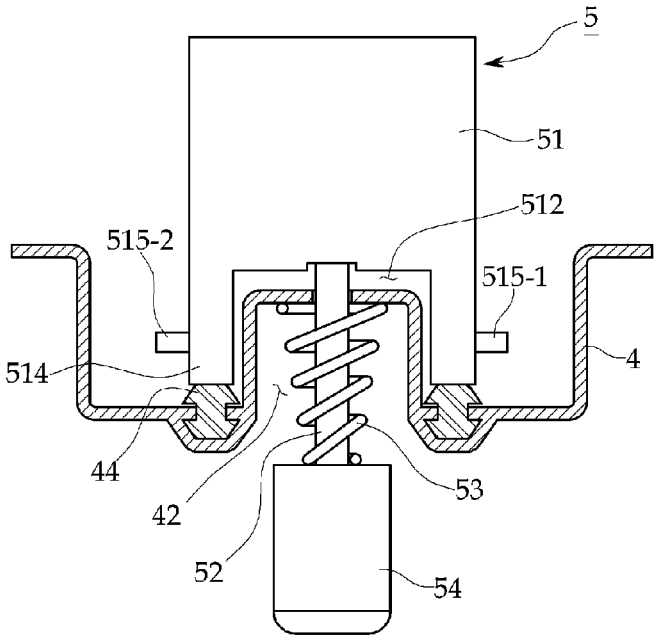
FIG. 8 is a transverse sectional view showing a coupling state between a locking member and a body.

FIG. 8 is a transverse sectional view showing a coupling state between the locking member and the body.

Referring to FIGS. 4 and 8, the cover 4 covers the front surface of the body 2. The cover 4 is installed at the front surface of the body 2 and provided with a plurality of fixing pin members 5 inserted into the insertion holes 20.

A front surface of the cover 4 is depressed inward so that a recess 42 is formed lengthwise along the cover 4. A plurality of holes (not shown) are formed in the recess 42 and the shaft pins 52 of the fixing pin members 5 are inserted into the holes.

The recess 42 has a shape corresponding to the shape of the recess 512 of the stopper 51. Anti-vibration pads 44 are installed at both sides of the recess 42 to make contact with the locking protrusion 514 of the stopper 51.

Preferably, the anti-vibration pads 44 are made from a silicon material. In addition, a lid 100 is mounted on the cover 4.

Hereinafter, the assembling relation among the elements of the weight control apparatus having the above structure according to the present invention will be described.

A pair of guides 16 are vertically installed between the supports 10 mounted on the base 11, and a plurality of stacks 17 are fitted with the guides 16.

Then, the body 2 is accommodated in the recess 172 of the body 2 of the stack 17 and the cover 4 is mounted on the front surface of the body 2.

A plurality of fixing pin members 5 are installed lengthwise along the cover 4.

In detail, the stoppers 51 are inserted into the insertion holes 20 of the body 2. At this time, the body 2 lies down on the ground or a working table (not shown) is disposed at the rear surface of the body 2 such that the stoppers 51 are prevented from being separated from the body 2.

Then, the cover 4 is coupled with the front surface of the body 2 so that the recess 42 of the cover 4 is accommodated in the recess 512 of the stopper 51.

After that, the conical coil spring 53 is fitted with the shaft pin 52 provided at the front end thereof with the button 54, and the rear end of the shaft pin 52 is inserted into the hole of the cover 4 to screw couple the rear end of the shaft pin 52 with the stopper 51.

Thus, the lower end portion of the conical coil spring 53 having a large diameter is supported by the cover 4 and the upper end portion of the conical coil spring 53 having a small diameter is supported by the button 54. Therefore, the stopper 51 is biased outward due to the elastic force of the conical coil spring 53, so that all buttons 54 of the fixing pin members 5 may protrude.

The locking member 3 is longitudinally installed at one side of the insertion holes 20 such that the locking protrusions 515-1 and 515-2 provided at both sides of the stopper 51 of the fixing pin member 5 are coupled with the locking member 3 and the safety guide 6 is longitudinally installed at the other side of the insertion holes 20.

Hereinafter, the operation of the weight control apparatus of the weight training machine according to the present invention will be described.

Figure 9:
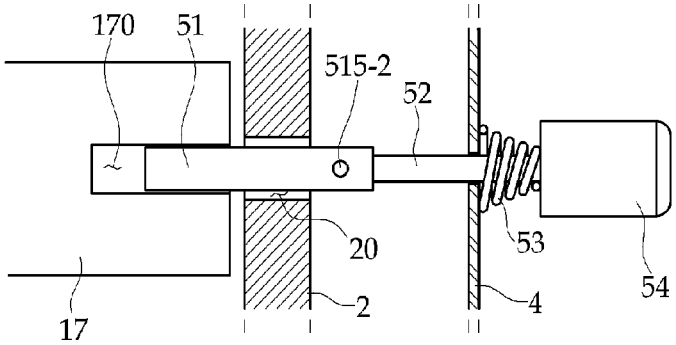
FIG. 9 is a sectional view showing a locking state between a locking member and a fixing pin member in a weight control apparatus of a weight training machine according to the present invention.

FIG. 9 is a sectional view showing a locking state between the locking member and the fixing pin member in the weight control apparatus of the weight training machine according to the present invention.

Referring to FIG. 9, if the user pushes the button 54, the stopper 51 moves forward so that the stopper 51 is inserted into the fixing hole 170 of the stack 17 by passing through the insertion hole 20 of the body 2.

FIG. 10 is a view showing an operational state of the fixing pin member in the weight control apparatus of the weight training machine according to the present invention.

Referring to FIG. 10, the locking protrusion 515-1 of the fixing pin member 5 moves down along the first inclined surface 351 of the locking protrusion 34 so that the plate member 32 is pushed upward.

If the locking protrusion 515-1 of the fixing pin member 5 moves beyond the first inclined surface 351 of the locking protrusion 34, the plate member 32 is pushed downward due to the restoring force of the spring 39 provided on the locking member 3, so that the locking protrusion 515-1 is inserted into the recess 352, which is the locking state.

Thus, if the user pushes up or pulls down the handle, the stacks 17 set by the user are moved up together with the body 2, so that the user can take exercise.

Figure 11:
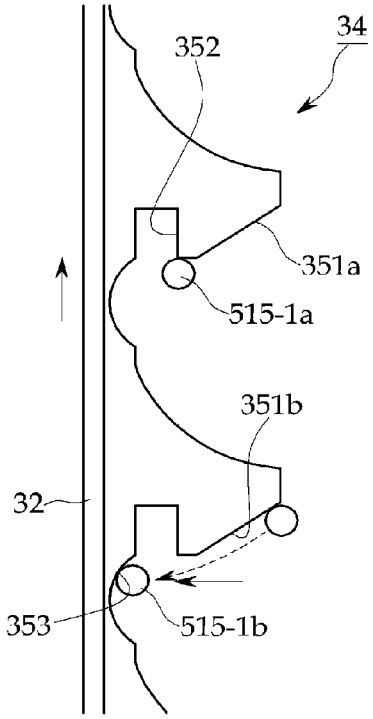
FIG. 11 is a view showing an operational state of a fixing pin member when a user changes the setting of stacks in a weight control apparatus of a weight training machine according to the present invention.

FIG. 11 is a view showing an operational state of the fixing pin member when the user changes the setting of stacks in the weight control apparatus of the weight training machine according to the present invention.

Referring to FIG. 11, if the user wants to change the weight of the stacks 17, the user pushes the button 54 of another fixing pin member 5. In this case, the stopper 51 moves forward so that the stopper 51 is inserted into the fixing hole 170 of the stack 17 by passing through the insertion hole 20 of the body 2.

At this time, the locking protrusion 515-1*b* of another fixing pin member 5 moves down along the inclined surface 351*b* of the locking protrusion 34 while pushing up the plate member 32 and further moves along the second inclined surface 353.

Thus, if the user pushes the button 54 with more strong force, the locking protrusion 515-1*b* of the stopper 51 is more deeply inserted, so that the locking protrusion 34 is further moved up and down. Therefore, the locking protrusion 515-1*a* of the stopper 51 is separated from the recess 352.

That is, the previous stopper 51 moves back due to the elastic force of the conical coil spring 53 installed on the previous stopper 51, so that the locking state is released.

At this time, the locking protrusion 514 of the released stopper 51 moving back due to the elastic force of the conical coil spring 53 makes contact with the anti-vibration pad 44, so that the impact and noise can be absorbed in the anti-vibration pad 44.

Figure 12:
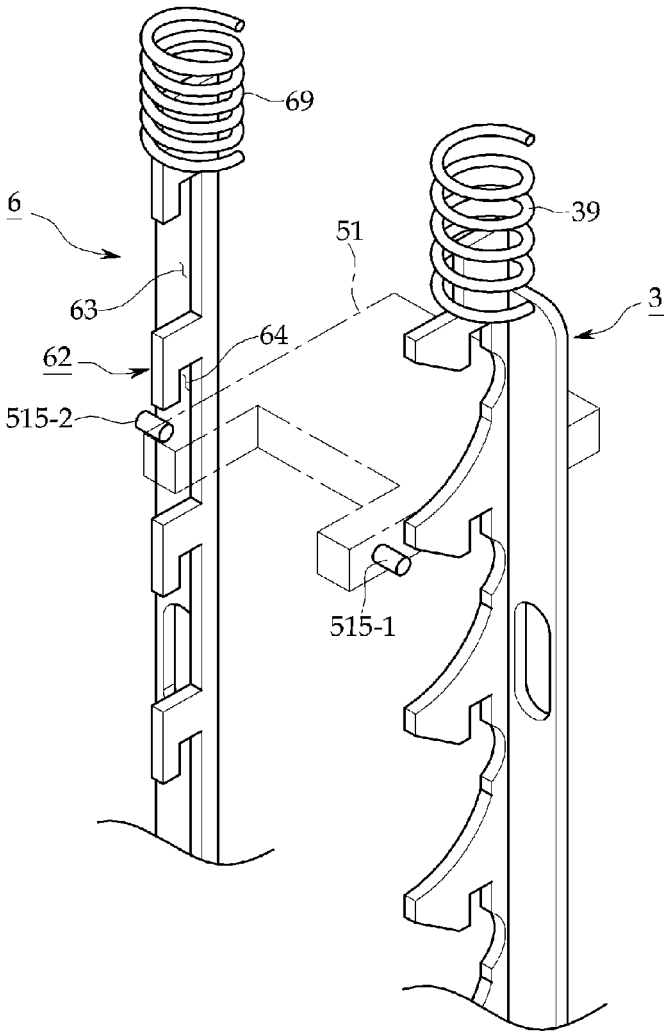
FIGS. 12 to 14 are views showing a locking state between a safety guide and a fixing pin member in a weight control apparatus of a weight training machine according to the present invention.
Figure 13:
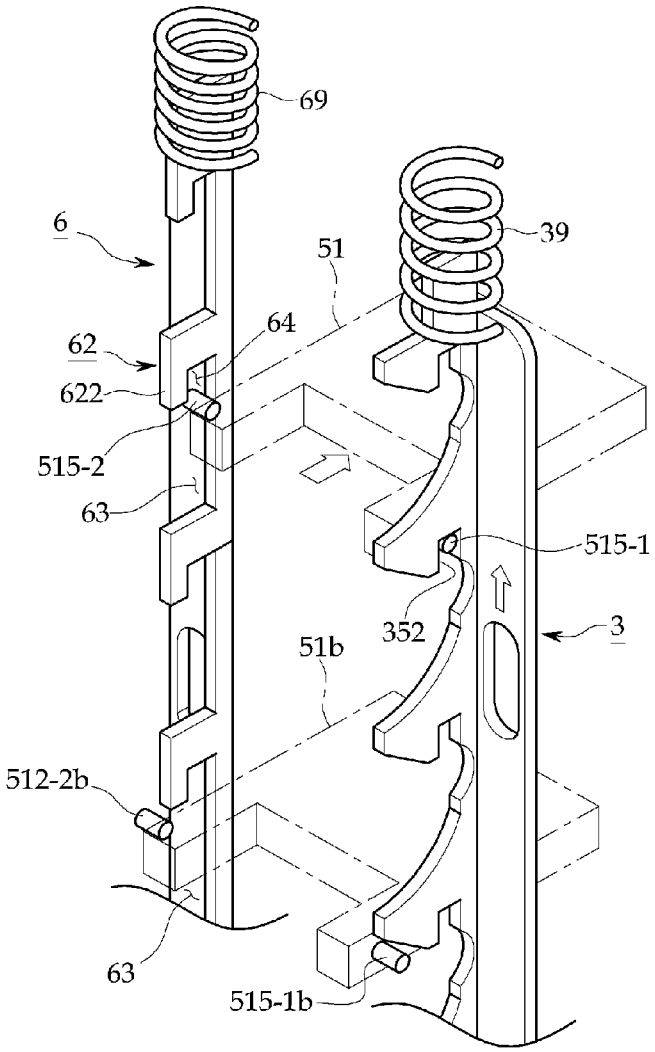
Figure 14:
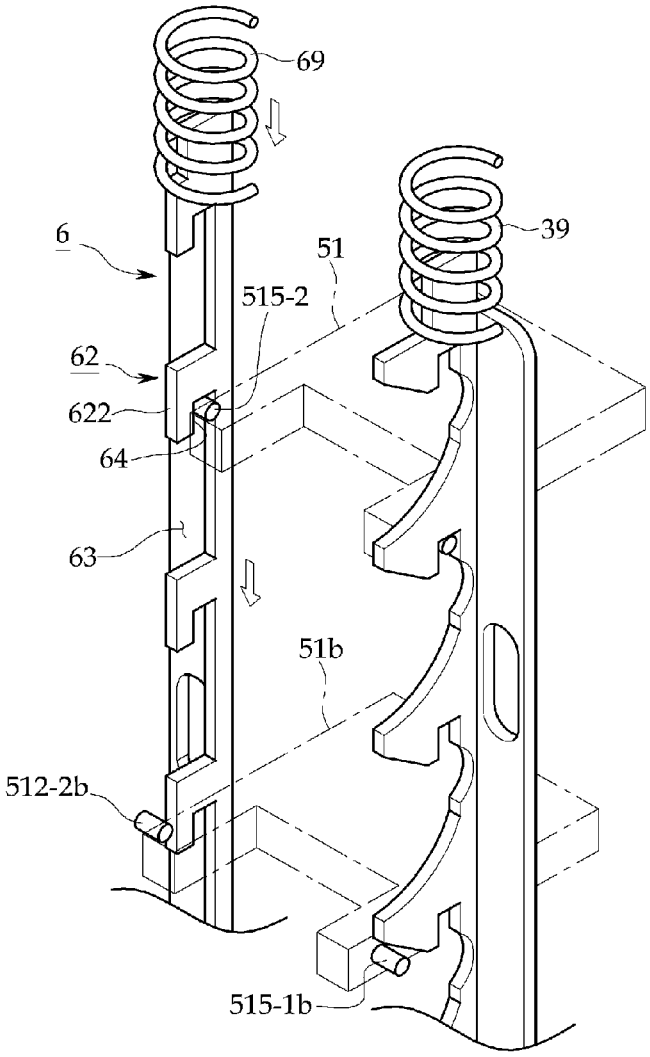

FIGS. 12 to 14 are views showing a locking state between the safety guide and the fixing pin member in the weight control apparatus of the weight training machine according to the present invention.

The function of the safety guide 6 may be easily understood with reference to FIGS. 12 to 14.

As shown in FIG. 12, since the button 54 and the stopper 51 are in the unlock state before the user sets the weight of the stacks 17, the locking protrusions 515-1 and 515-2 are not introduced into the locking member 3 and the safety guide 6.

In this case, the locking button 61 provided at the lower end of the safety guide 6 makes contact with the base 11, so that the safety guide 6 has been moved up. Therefore, the safety spring 69 provided at the upper portion of the safety guide 6 is compressed.

Then, as shown in FIG. 13, if the user pushes the button 54 to set the weight of the stacks 17, as described above with reference to FIG. 10, the locking protrusion 515-1 of the stopper 51 is inserted into the recess 352 of the locking member 3.

At the same time, the locking protrusion 515-2 of the stopper 51 moves beyond the locking protrusion 62 of the safety guide 6 just before a recess 64. At this time, the safety spring 69 is still compressed.

Meanwhile, in this state, the locking protrusion 515-2*b* of the stopper 51*b*, which corresponds to the button 54 that is not pressed, is still not introduced into the recess 63.

After that, as shown in FIG. 14, if the user pushes up or pulls down the handle, the locking button 61 of the safety guide 6 is spaced apart from the base 11, so that the safety spring 69 is expanded due to the elasticity. Thus, the safety guide 6 moves down so that the locking protrusion 515-2 of the stopper 51 is inserted into the recess 64.

In this state, the locking protrusion 515-2*b* of the stopper 51*b*, which corresponds to the button 54 that is not pressed, makes contact with the vertical surface 622 of the locking protrusion 62 of the safety guide 6, so the stopper 51*b* may not be operated even if other buttons are pressed.

Thus, if other buttons are unnecessarily pressed when the user takes exercise, other stoppers may not be operated, so that the user may safety take exercise.

After that, if the user has finished the exercise, the locking button 61 of the safety guide 6 makes contact with the base 11, so that the safety guide 6 moves up and the safety spring 69 provided at the upper portion of the safety guide 6 is compressed. Thus, the locking protrusion 515-2 of the stopper 51 is separated from the recess 54.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A weight control apparatus of a weight training machine, the weight control apparatus comprising:

a plurality of stacks which are fitted to a pair of guides standing upright between supports on a base such that the stacks slidably move up and down, and which have rectangular locking holes;

a body arranged on a front surface of the base, in which the body has a plurality of insertion holes corresponding to the locking holes of the stacks and is provided at an upper portion thereof with a holder; and a cover arranged on the front surface of the body and having a plurality of locking pin members inserted into the insertion holes, wherein each locking pin member includes:

a rectangular stopper having a recess inwardly recessed, protrusions protruding from both sides of the recess, and locking protrusions protruding from both sides of the stopper;

a shaft pin connected to a front end of the stopper;

a button arranged on a front end of the shaft pin; and a conical coil spring arranged between the button and the shaft pin.

2. The weight control apparatus of claim 1, wherein the body is provided therein with a locking member locked with or unlocked from the locking protrusions of the fixing pin member, the locking member includes a plate member having a predetermined length and provided at an upper end thereof with a spring, and a locking protrusion protruding from one side of the plate member, and the locking protrusion includes:

a protrusion having a trapezoidal shape and formed with a first inclined surface inclined downward and an incised surface horizontally incised in adjacent to the first inclined surface;

a recess which is inwardly recessed and disposed below the first inclined surface;

a second inclined surface disposed below the recess and inclined in a direction identical to an inclination direction of the first inclined surface; and a groove adjacent to the second inclined surface.

3. The weight control apparatus of claim 2, wherein a lower end of the plate member of the locking member protrudes downward from the body, and a reset button is provided at the lower end of the plate member, and wherein, when the reset button is pressed, the locking member is moved up so that all locked stoppers are released, thereby releasing a locking state of the fixing pin member.

4. The weight control apparatus of claim 2, further comprising a rolling unit installed between the plate member of the locking member and an inner surface of the body to facilitate a movement of the plate member, wherein the rolling unit is accommodated in a rolling groove formed in the body and the rolling groove has a size sufficient for providing an extra space when the rolling unit is accommodated in the rolling groove, so that the rolling unit is able to roll in the rolling groove when the plate member moves up and down, thereby facilitating the up-down movement of the plate member.

5. The weight control apparatus of claim 1, wherein a front surface of the cover is recessed inward so that a recess is formed lengthwise along the cover, a plurality of holes are formed in the recess, the shaft pin of the fixing pin member is inserted into the holes, and anti-vibration pads are installed at both sides of the recess to make contact with the locking protrusion.

6. The weight control apparatus of claim 2, wherein a safety guide is installed in the body in opposition to the locking member, the safety guide includes a plate member having a predetermined length and provided at an upper end thereof with a safety spring, a plurality of locking protrusions and a plurality of grooves, the locking protrusions and the grooves are alternately formed in a regular interval at one side of the plate member, a vertical surface is formed at a front surface of the locking protrusion, a recess is formed at a lower portion of the locking protrusion, and a locking button is provided at a lower end of the plate member.

* * * * *